United States Patent [19]

Nelson

[11] Patent Number: 4,700,737

[45] Date of Patent: Oct. 20, 1987

[54] COMBINATION WALL MOUNT, CADDY MOUNT GARDEN HOSE REEL

[75] Inventor: Terry N. Nelson, Shoreview, Minn.

[73] Assignee: The Specialty Mfg. Co., St. Paul, Minn.

[21] Appl. No.: 902,171

[22] Filed: Aug. 29, 1986

[51] Int. Cl.[4] ..... A62C 35/00; B65H 75/40

[52] U.S. Cl. ..... 137/355.27; 137/355.26; 137/360; 242/86.2; 248/76; 248/89

[58] Field of Search ..... 242/86, 86.2; 137/355.16, 355.26, 355.27, 360; 248/76, 89

[56] References Cited

U.S. PATENT DOCUMENTS

| | | | |
|---|---|---|---|
| 215,709 | 5/1879 | Abbott | 242/86.2 |
| 672,543 | 4/1901 | Wirt | 242/86 |
| 698,346 | 4/1902 | Wood | 137/355.26 |
| 889,038 | 5/1908 | Parker | 137/355.26 |
| 994,025 | 5/1911 | Montgomery | 242/86 |
| 1,058,538 | 4/1913 | Boss | 137/355.12 |
| 1,061,642 | 5/1913 | Stoup | 137/355.26 |
| 1,255,854 | 2/1918 | Boss | 137/355.12 |
| 1,449,730 | 3/1923 | Casper et al. | 137/355.26 |
| 2,488,425 | 11/1949 | Morrone | 242/86.2 |
| 2,602,605 | 7/1952 | Shilling | 137/355.26 |
| 2,805,100 | 9/1957 | Shaver | 299/78 |
| 2,964,258 | 12/1960 | Kutil | 242/186 |
| 3,027,141 | 3/1962 | Ellis | 254/166 |
| 3,587,626 | 6/1971 | Cowley et al. | 137/355.12 |
| 4,137,939 | 2/1979 | Chow | 137/355.27 |
| 4,512,361 | 4/1985 | Tisbo et al. | 137/355.27 |

FOREIGN PATENT DOCUMENTS

| | | | |
|---|---|---|---|
| 265004 | 2/1927 | United Kingdom | 242/86 |
| 313334 | 6/1929 | United Kingdom | 137/355.26 |
| 331238 | 6/1930 | United Kingdom | 137/355.26 |

*Primary Examiner*—A. Michael Chambers

*Attorney, Agent, or Firm*—Dorsey & Whitney

[57] ABSTRACT

A garden hose reel is provided that may selectively be mounted on either a portable caddy or a fixed wall bracket. The garden hose reel hereof comprises a rotatable reel mounted on a U-shaped yoke. The yoke has a vertical arm depending downwardly from the midpoint of the yoke that is pivotally received by either a caddy supported bracket or wall mounted bracket. A latch assembly selectively holds the reel in a fixed position, and limits the angle through which the reel may be pivoted.

14 Claims, 7 Drawing Figures

COMBINATION WALL MOUNT, CADDY MOUNT GARDEN HOSE REEL

TECHNICAL FIELD

This invention pertains to lawn care devices. In particular, it pertains to a garden hose reel that can be mounted on a wall or on a portable caddy.

BACKGROUND ART

Windable reels for compactly storing flexible garden hose are well known. A reel that can be detachably coupled to a wall mounted faucet, for instance, is disclosed in U.S. Pat. No. 1,058,538 to William Boss. A hose reel that is supported on a portable caddy is disclosed in U.S. Pat. No. 1,255,854 to William Boss. Other variations of wall mounted and caddy mounted hose reels are disclosed in U.S. Pat. Nos. 2,805,100, 2,964,258, 3,587,626, 4,137,939, and 4,512,361. Each of the aforementioned garden hose reels are restricted to either a wall mount or a caddy mount. A garden hose reel that could be selectively wall mounted or caddy mounted would be a decided advantage.

SUMMARY OF THE INVENTION

The present invention comprises a garden hose reel that can be either wall mounted or caddy mounted. The hose reel hereof comprises a yoke mounted plastic hose reel. The reel has an axially mounted hose connection on one side and an axially mounted crank on the opposed side. A flexible hose connects the reel to a water faucet. A hose connection outlet is mounted on the drum of the reel. The reel is mounted on axial bearings supported by opposed arms of a U-shaped yoke. The yoke has a vertical pivot arm welded at at the midpoint of the yoke. The pivot arm is selectively receivable within either a wall mounted or caddy mounted support bracket. The pivot arm can be latched in places within the support bracket, or may be allowed to pivot within a predetermined range of pivot angles.

The particular construction of the hose reel and yoke in accordance with the present invention provides several advantages. First of all, the unique reel and yoke assembly permits ready interchange between wall mounting and portable caddy mounting. Second, the U-shaped yoke with integral pivot arm allows the reel to pivot in its support bracket. The reel is thus free to pivot to the direction from which hose is being removed, preventing binding of the hose and reel, and subsequent tipping of the caddy mount. Third, a latch mechanism is provided that selectively locks the reel in a fixed position for rewinding the hose. Fourth, the pivot arm includes a swing limiting stop for restricting the angle through which the reel can be swung, thereby maintaining the center of gravity of the hose reel within a spacial range that is supportable by the caddy base.

DETAIL DESCRIPTION OF THE DRAWINGS

Figure 1:
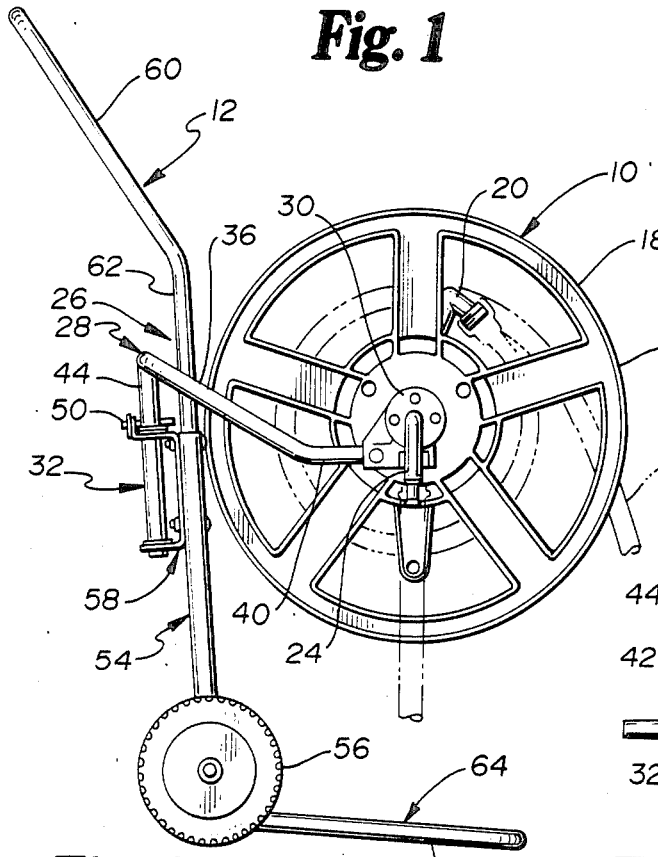
FIG. 1 is a side elevational view of a garden hose reel in accordance with the present invention mounted on a portable caddy.

Referring to the drawings, a garden hose reel 10 is depicted alternatively in conjunction with a portable caddy 12 or a wall mount bracket 14. The hose reel 10 includes a hose support surface 16, opposed reel sides 18, an outlet tube 20 for watertight connection with a flexible hose 22, an inlet tube 24, and a reel support assembly 26.

The reel support assembly 26 broadly includes a U-shaped yoke 28, reel support bearings 30, and a downwardly extending pivot arm 32. The U-shaped yoke 28 includes generally horizontal, rear support rod 34, and opposed, downwardly angled yoke arms 36, 38. The yoke arms 36, 38 each include generally horizontal end portions 40, 42. Reel support bearings 30 are carried by respective yoke arm end portions 40, 42. The reel support rod 34, yoke arms 36, 38, and yoke arm end portions 40, 42 are preferably integrally formed.

Pivot arm 32 comprises L-shaped rod 44. The horizontal, upper portion 46 of L-shaped rod 44 is fixedly attached to the rear support rod 34 of U-shaped yoke 28. The generally vertical, lower portion 48 of L-shaped rod 44 is positioned at the approximate midpoint of rear support rod 34. Pin 50 is carried within bored through channel 52 of the lower portion 48 of L-shaped rod 44. The pin 50 is oriented generally parallel to the plane defined by respective yoke arm and yoke arm end portions 36, 40, and 38, 42. End 50 extends outwardly from both sides of the lower portion 40 of L-shaped rod 44.

Portable caddy 12 broadly includes frame 54, support wheels 56, and reel mounting bracket 58. The frame 54 includes handle 60, back support 62, and forwardly extending, generally horizontal support stand 64. As depicted in FIG. 1, caddy wheels 56 are oriented rearwardly of the axis of rotation of hose reel 10, and the support stand 64 extends from the caddy wheels to a point forward of the axis of rotation of the hose reel 10. The support stand 64 includes generally parallel, forwardly extending, opposed arms 65, 68, and cross bar 70 interconnecting the arms 66, 68.

Reel support bracket 58 includes back plate 72 fixably coupled to back support 62 of caddy frame 54, and upper and lower, opposed, generally parallel, rearwardly extending, pivot arm support plates 74, 76. Upper pivot arm support plate 74 includes upwardly extending, opposed, pivot arm pin engaging stops 78, 80. Pivot pin receiving notch 82 is defined by the mutually facing marginal edges 84, 86 of stops 78, 80. Latch leaf 88, including pivot arm pin engaging groove 90, is pivotally carried by stop 80.

Figure 3:
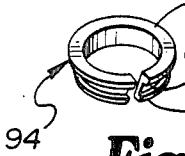
FIG. 3 is an enlarged, perspective view of a bracket bushing element.
Figure 4:
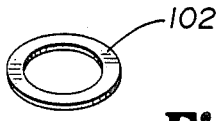
FIG. 4 is an enlarged, perspective view of a bracket thrust washer element.

Upper support plate 74 of reel support bracket 58 defines pivot arm receiving aperture 92. A synthetic resin bushing 94 is carried within aperture 92. As depicted in FIG. 3, bushing 94 comprises a split bushing having upper and lower radially outwardly extending flanges 96, 98 to define retaining groove 100. Metallic, flat washer 102 (FIG. 4) is carried by pivot arm 32, interposed between bushing 94 and pin 50. Lower support plate 76 defines pivot arm receiving aperture 104 oriented directly below the upper plate pivot arm receiving aperture 92. A second bushing identical to bushing 94 is carried by the lower plate receiving aperture 104.

Figure 7:
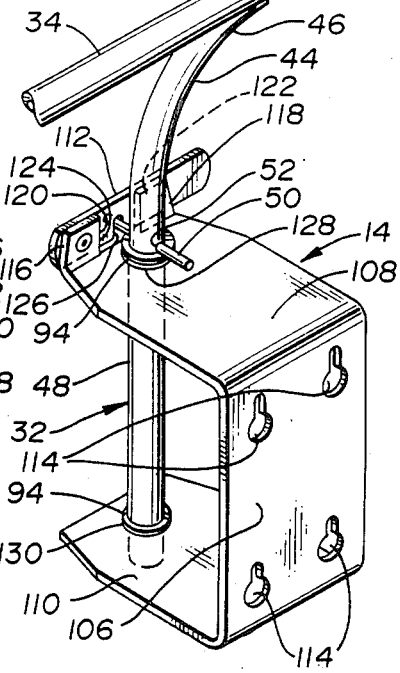
FIG. 7 is a perspective view of a wall mount bracket for the garden hose reel.

Referring to FIG. 7, wall mount bracket 14 broadly includes back plate 106, opposed, generally parallel, upper and lower pivot arm support plates 108, 110, and latch leaf 112. Back plate 106 includes screw receiving mounting apertures 114. Upper plate 108 includes upwardly extending stops 116, 118. The mutually facing margins 120, 122 of stops 116, 118 respectively define pin receiving notch 124. Latch leaf 112 including pin receiving groove 126 is pivotally attached to stop 116. Upper support plate 108 defines pivot arm receiving aperture 128. Lower support plate 110 defines pivot arm receiving aperture 130. Lower aperture 128 is vertically aligned with and directly below upper plate aperture 130. Bushings 94 are carried by each aperture 120 and 130. A flat washer thrust bearing 102 is carried by pivot arm 32, interposed between the upper aperture bushing and pin 50.

Figure 2:
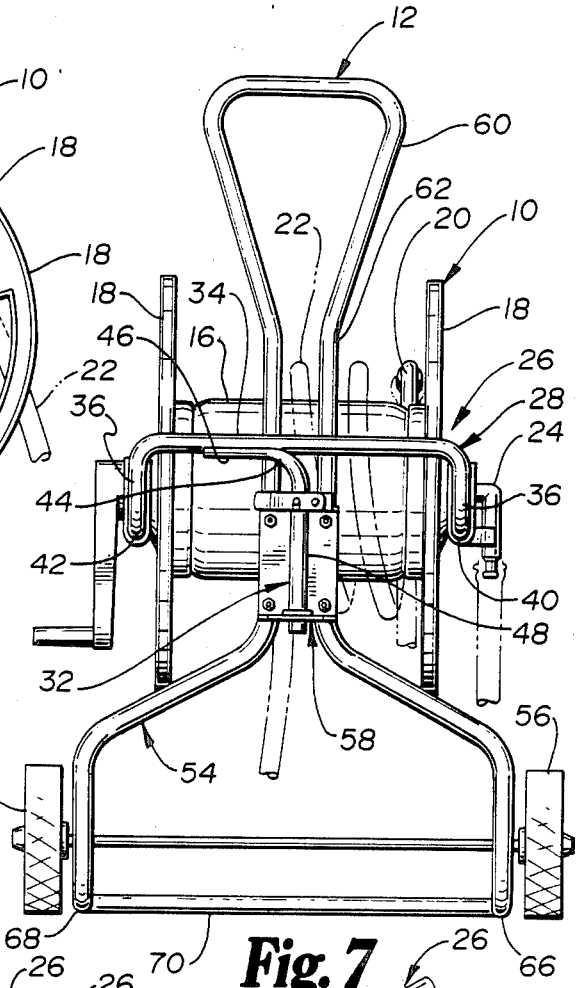
FIG. 2 is a rear elevational view of the apparatus depicted in FIG. 1.
Figure 5:
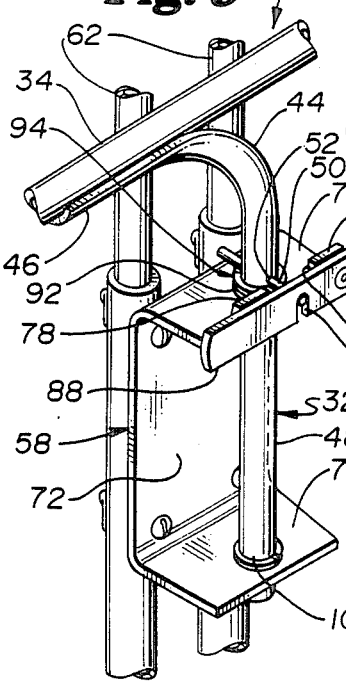
FIG. 5 is a fragmentary, perspective view of a caddy mounted pivot arm support bracket.
Figure 6:
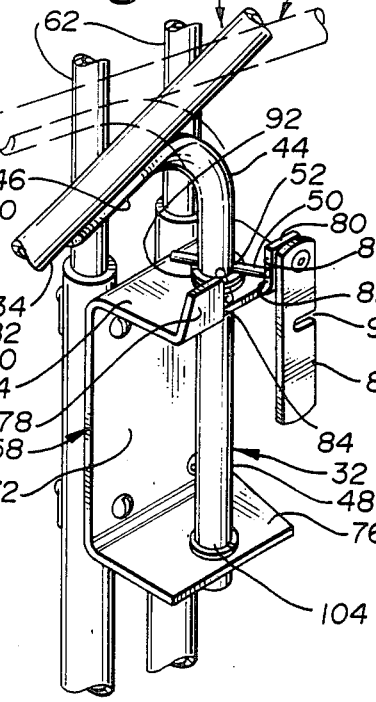
FIG. 6 is similar to FIG. 5 with the pivot arm in an alternative position, phantom lines depicting the pivot arm in a tertiary position.

In operation, the hose reel 10 and reel support assembly 26 comprise a detachable unit that can be mounted either on portable caddy 12 or wall mount bracket 14. As depicted in FIGS. 1 and 2, the lower portion 48 of L-shaped rod 44 of pivot arm 32 is received through the upper plate and lower plate receiving apertures 92, 94 of caddy reel support bracket 58. The synthetic resin bushings 94 carried by the apertures provide for free pivoting movement of the pivot arm 32. Pin 50 abuts against the flat washer 102, vertically positioning the reel support assembly 26 within the bracket 58. As depicted in FIG. 6, one end of pin 50 extends through the notch 82 defined by bracket stops 78, 80. The reel 10 may be center lined and fixed in position by orienting the pin 50 in the midway position of notch 82, and dropping the latch leaf 88 over the pin 50 to receive the pin 50 within latch leaf groove 90 (see FIG. 5). Alternatively, latch leaf 88 may be shifted to the position depicted in FIG. 6, allowing reel support assembly 26 and hose reel 10 to pivot. The pivoting action of the reel 10 is confined by the interaction of the pin 50 and notch 82, however, such that the center of gravity of the hose reel 10 is maintained within a spacial orientation relative to the caddy frame 54 such that the caddy 12 is maintained in an upright position, and not tipped over under its own weight.

The hose reel 10 and hose support assembly 26 may be lifted upwardly out of the caddy reel support bracket 58. Once removed from the caddy 12, the hose reel 10 and reel support assembly 26 may be inserted into a wall mount bracket 14. The operation of the hose reel and reel support assembly 26 within the wall mount bracket 14 is similar to its operation within the caddly reel support bracket 58. It will be noted, however, that the opposite end of pin 50 interacts with the notch 124 of wall mount bracket 14 as compared to the end of pin 50 that interacts with the notch 82 of caddy support bracket 58.

I claim:

1. A combination wall mount and caddy mount for storing a flexible hose on a reel, comprising:

a hose reel support structure for rotatably supporting the reel, including a yoke, including a yoke base and yoke arms, with the yoke arms operably connected to the reel; and a generally vertically oriented elongate support member fixedly connected to the yoke base and downwardly depending from the hose reel support structure and having a lower end;

a bracket assembly for selectively removably receiving the support member including a first support element presenting an upper surface and including structure defining an upper aperture for receiving the support member;

a second support element vertically spaced apart from the first support element a predetermined distance and oriented generally below the first support element and including structure defining a lower aperture for receiving the support member, such that a generally vertically oriented support axis is defined by the upper and lower apertures; and height positioning means fixedly connected to the support member at a point above the lower end of the support member not less than the predetermined distance between the upper support element and the lower support element for abutably engaging the upper surface of the first support element and allowing the lower end of the support member to be inserted completely through the upper aperture along the path of travel defined by the support axis and then inserted at least into the lower aperture, whereby the hose reel support structure may be mounted in the bracket assembly by slidably inserting the lower end of the support member through the upper aperture and toward the lower aperture until the horizontal positioning means vertically positions the support member in the bracket assembly by restraining the support member from continuing downward along a path of travel defined by the support axis, and the hose reel support structure may be removed from the bracket assembly by lifting the hose reel support structure upwardly until the lower end of the support member is above the upper support element.

2. The combination wall mount and caddy mount of claim 1 wherein the support member has a horizontal cross section and the upper and lower support element apertures have horizontal cross sections which are slightly larger than and correspond to the horizontal cross section of the support member such that the support member and upper and lower support element apertures interact to allow the support member to pivot horizontally when mounted in the upper and lower support element apertures of the bracket assembly.

3. The combination wall mount and caddy mount of claim 2 wherein the bracket assembly further comprises upwardly extending stop means operably connected to the upper surface of the first support element for selectively engagaing the height positioning means to limit the range of horizontal pivot movement of the support member when the support member is mounted in the bracket assembly.

4. The combination wall mount and caddy mount of claim 3 wherein the bracket assembly further comprises latch means operably coupled to the bracket assembly for selectively engaging the support member such that the horizontal pivot movement of the support member is inhibited.

5. The combination wall mount and caddy mount of claim 4 wherein the latch means is a latch element operably, pivotally coupled to the first support element, the latch element presenting a lower horizontal edge having a height positioning means engaging groove disposed therein.

6. The combination wall mount and caddy mount of claim 1 wherein the bracket assembly further comprises bushing elements operably retained within the upper and lower apertures.

7. The combination wall mount and caddy mount of claim 2 wherein the support member includes a generally horizontally horizontal postioning means is a support member bored-through channel for the horizontal positioning means and the horizontal positioning means is a support member pin disposed within the bored-through channel having at least one support member pin end extending horizontally beyond the support member.

8. A combination wall mount and caddy mount hose reel for storing a flexible hose, comprising:

a reel for windably supporting the flexible hose;

a reel support assembly for rotatably supporting the reel, including a U-shaped yoke, including a yoke base and yoke arms, with the yoke arms operably connected to the reel; and an elongate pivot arm fixedly connected to and downwardly depending from the yoke base at a substantially right angle to the plane defined by the yoke and having a lower end and a uniform horizontal cross section; and a reel support bracket for selectively removably receiving the reel support assembly, including a generally vertical back support;

a first support plate operably connected to the back support and presenting an upper surface and including structure defining an upper aperture having a horizontal cross section corresponding to and slightly larger than the horizontal cross section of the pivot arm for receiving the pivot arm; and a second support plate operably connected to the back support and vetrically spaced apart from the first support plate a predetermined distance and oriented generally below the first support plate and including structure defining a lower aperture having a horizontal cross section corresponding to and slightly larger than the horizontal cross section of the pivot arm for receiving the pivot arm; and pin means fixedly connected to the pivot arm; at a point above the lower end of the pivot arm not less than the predetermined distance between the upper support plate and lower support plate for abutably engaging the upper surface of the first support plate and allowing the lower end of the pivot arm to be inserted completely through the upper aperture along the path of travel defined by the support axis and then into the lower aperture, whereby the reel support assembly may be mounted in the reel support bracket by slidably inserting the lower end of the pivot arm through the upper aperture and toward the lower aperture until the pin means vertically positions the pivot arm in the reel support bracket by restraining the pivot arm from continuing downward along a path of travel defined by the support axis the pivot arm being horizontally rotatable within the reel support bracket, and the reel support assembly may be removed from the reel support bracket lifting the reel support assembly upwardly until the lower end of the pivot arm is above the upper support plate.

9. The combination wall mount and caddy mount hose reel of claim 8 wherein the reel support bracket further comprises upwardly extending stop means operably connected to the upper surface of the first support plate for selectively engaging the pin means to limit the range of horizontal pivot movement of the pivot arm when the pivot arm is mounted in the reel support bracket.

10. The combination wall mount and caddy mount hose reel of claim 9 wherein the reel support bracket further comprises latch means operably coupled to the reel support bracket for locking the pivot arm such that the horizontal pivot movement of the pivot arm is inhibited.

11. The combination wall mount and caddy mount hose reel of claim 10 wherein the latch means is a latch element operably pivotally coupled to the first support plate, the latch element presenting a lower horizontal edge having a pin means engaging groove disposed therein.

12. The combination wall mount and caddy mount hose reel of claim 8 wherein the bracket assembly further comprises bushing elements operably retained within the upper and lower apertures.

13. The combination wall mount and caddy mount hose reel of claim 8 wherein the pivot arm includes a generally horizontally bored-through channel for the pin means and the pin means is a pivot arm pin disposed within the bored-through channel having at least one pivot arm pin end extending horizontally beyond the pivot arm.

14. The combination wall mount and caddy mount hose reel of claim 8 further includes a portable caddy, further comprising:

a caddy frame, including a handle;

a generally vertical back support structure;

a caddy frame bracket mount for removably receiving the reel support structure; and a generally horizontal support stand; and a pair of wheels operably connected to the caddy frame.

* * * * *

UNITED STATES PATENT AND TRADEMARK OFFICE

CERTIFICATE OF CORRECTION

PATENT NO. : 4,700,737

DATED : October 20, 1987

INVENTOR(S) : Terry N. Nelson

It is certified that error appears in the above-identified patent and that said Letters Patent is hereby corrected as shown below:

Column 3, line 54, delete the word "caddly" and insert therefor --caddy--.

Column 4, line 53, delete the word "engagaing" and insert therefor --engaging--.

Column 5, line 7, delete the words "horizontal positioning means is a support member".

Column 5, line 37, delete the word "vetrically" and insert therefor --vertically--.

Column 5, line 44, delete the ";".

Signed and Sealed this

Twenty-fourth Day of May, 1988

*Attest:*

DONALD J. QUIGG

*Attesting Officer*

*Commissioner of Patents and Trademarks*